United States Patent [19]

Christoffersson

[11] Patent Number: 4,553,580

[45] Date of Patent: Nov. 19, 1985

[54] VENETIAN BLIND

[76] Inventor: Evert Christoffersson, Stenbrunnsvagen 11, S-216 22 Malmo, Sweden

[21] Appl. No.: 504,131

[22] Filed: Jun. 15, 1983

[30] Foreign Application Priority Data

Jun. 15, 1982 [SE] Sweden ..... 8203704

[51] Int. Cl.[4] ..... E06B 9/30

[52] U.S. Cl. ..... 160/172; 160/107

[58] Field of Search ..... 160/84 R, 107, 172, 160/173; 248/201, 256, 257, 265, 300

[56] References Cited

U.S. PATENT DOCUMENTS

| | | | |
|---|---|---|---|
| 2,509,033 | 5/1950 | Carver | 160/84 R |
| 2,795,271 | 6/1957 | Angelo | 160/172 |
| 4,168,734 | 9/1979 | Holmquist et al. | 160/23 R |
| 4,341,254 | 7/1982 | Schaller et al. | 160/172 |

FOREIGN PATENT DOCUMENTS

| | | | |
|---|---|---|---|
| 1509608 | 4/1970 | Fed. Rep. of Germany . | |
| 216625 | 10/1967 | Sweden | 160/107 |
| 1113641 | 5/1968 | United Kingdom | 160/107 |

*Primary Examiner*—Peter M. Caun

*Attorney, Agent, or Firm*—Lerner, David, Littenberg, Krumholz & Mentlik

[57] ABSTRACT

A Venetian blind to be mounted in a window casement or window frame, comprising a channelled suspension rail arranged horizontally at the top and mounting the operating mechanism of the blind, and two vertical guide rails for the slats of the blind, mounted one at each side and forming a support for the associated end of the suspension rail. This rail at one end thereof is positively engaged with one guide rail while a manually adjustable latch element is provided at the other end of the suspension rail for positive engagement with the other guide rail.

19 Claims, 16 Drawing Figures

VENETIAN BLIND

The present invention relates to a Venetian blind to be mounted in a window casement or window frame, comprising a channelled suspension rail arranged horizontally at the top and mounting the operating mechanism of the blind, and two vertical guide rails for the slats of the blind, mounted one at each side and forming a support for the associated end of the suspension rail.

The primary object of the invention is to provide a Venetian blind of the kind referred to above which can be mounted easily to the window casement or the window frame by connecting the guide rails to the side sections of the casement or frame and then connecting the suspension rail to the upper ends of the guide rails.

A further object of the invention is to make possible that this mounting can be performed by anybody without any skill in the art so that the Venetian blind can be manufactured by the manufacturer in accordance with the width and height of the window and can be delivered to the purchaser as a kit to be mounted to the casement or frame by the purchaser in a simple manner.

A still further object of the invention is to provide a Venetian blind of the kind referred to above which can easily be dismounted from the window casement or window frame when it is desired to clean the window of to repaint the casement or frame.

To achieve the foregoing objects and in accordance with the purpse of the invention the Venetian blind of the kind referred to above is characterized in that the suspension rail at one end thereof is positively engaged with one guide rail and at the other end thereof is provided with a manually adjustable latch element for positive engagement with the other guide rail.

In order to illustrate the invention embodiments thereof will be described in more detail below with reference to the accompanying drawings, in which.

Figure 1:
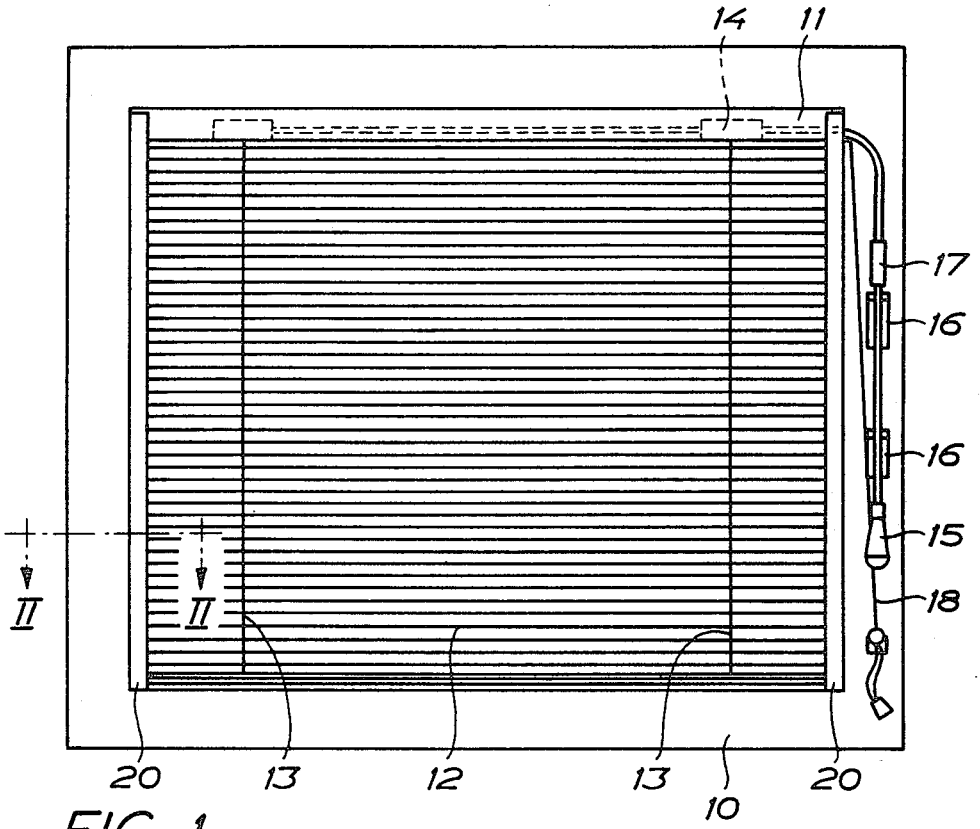
FIG. 1 is a front elevational view of a window casement with a Venetian blind according to the invention.

Referring to FIG. 1, the Venetian blind of the invention shown therein is mounted in a window casement 10 and comprises a suspension rail 11 consisting of a U-shaped channel open at each end thereof, from which the slats 12 are suspended by means of ladder cords 13. A conventional operating mechanism 14 for adjusting the slats between substantially horizontal and vertical positions and tilted positions therebetween is mounted in the suspension rail 11 and is connected to an operating bar 15 detachably mounted in fittings 16 on the window casement. The operating bar can be disengaged from the operating mechanism at a connection 17. A pull cord 18 is provided in the usual manner for stacking the slats from the lowermost slat upwardly as is well known in the art.

Figure 2:
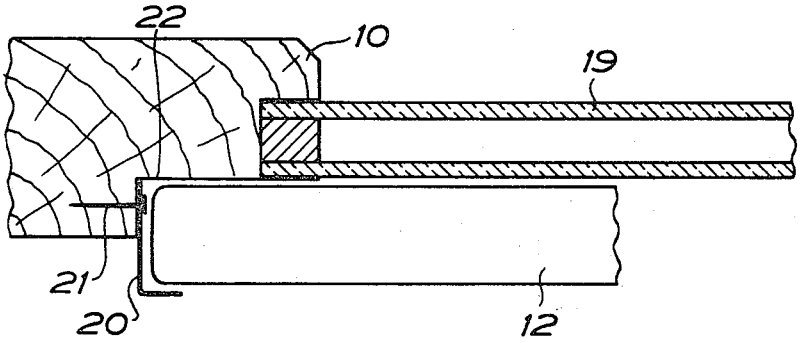
FIG. 2 is an enlarged fragmentary cross-sectional view taken along line II—II in FIG. 1.
Figure 3:
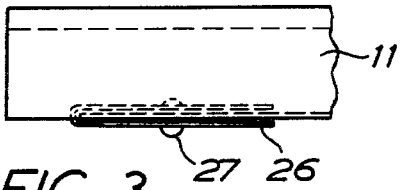
FIG. 3 is a fragmentary side view of one end of the suspension rail where a latch slide is provided.
Figure 4:
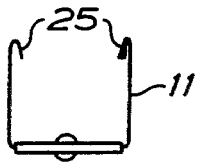
FIG. 4 is an end view of the suspension rail as seen from the end where the latch slide is provided.

As will be seen from FIG. 2 a two-pane insulating window 19 is mounted to the window casement 10. The Venetian blind is mounted at the inner side of the window, the slats 12 being guided by means of two vertical guide rails 20 of L-formed cross-sectional form, which are connected to the window casement 10 by means of nails 21 in a groove 22 formed by the casement. The guide rails can also be mounted by means of screws or self-adhesive tape. The suspension rail 11 is connected to the upper ends of the two guide rails 20 in a manner to be described in more detail with reference to FIGS. 3 to 11.

Figure 5:
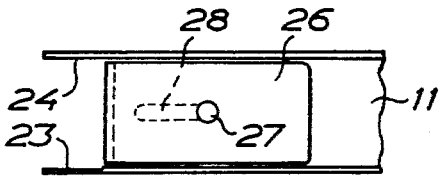
FIG. 5 is a fragmentary plan view of the suspension rail at the end thereof where the latch slide is provided, said slide being shown in a disengaged position.
Figure 6:
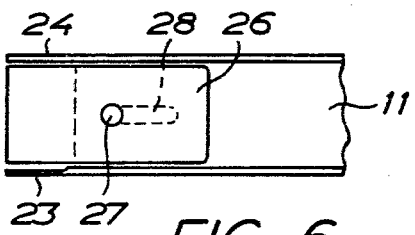
FIG. 6 is a fragmentary plan view similar to that of FIG. 5 but with the latch slide shown in an engaged position.

As will be seen from FIGS. 3 to 6 the web of the U-shaped suspension rail 11 is cut away over a portion at the left end of the rail as seen in FIGS. 5 and 6, so that the two upright sides of the rail project in a counter-lever fashion at 23 and 24, respectively. The upright sides of the suspension rail are folded at the free edge thereof as shown at 25, and the folded portion is flattened on the projecting portion 23. A latch slide 26 comprises a double-folded thin metal sheet which fits between the upright sides of the suspension rail 11 and straddles the web of the rail. A rivet 27 passes through the slide and through a slot 28 in the web of the suspension rail 11, and the latch slide 26 is displaceable in the longitudinal direction of the suspension rail within the limits defined by the rivet 27 and the slot 28, between an off position according to FIG. 5 in which the latch slide is withdrawn from the projecting portions 23 and 24 of the upright sides of the suspension rail, and a latch position, FIG. 6, in which the latch slide extends between the projecting portions 23 and 24 of the upright sides of the suspension rail and the left end of the slide is flush with the left end of the suspension rail 11.

Figure 7:
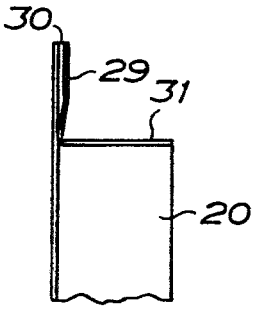
FIG. 7 is a fragmentary side view of the upper end portion of a guide rail.
Figure 8:
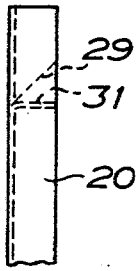
FIG. 8 is a fragmentary side view of the guide rail, perpendicular to the view of FIG. 7.
Figure 9:
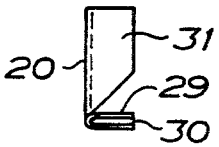
FIG. 9 is an end view of the guide rail shown in FIGS. 7 and 8.

Referring now to FIGS. 7 and 9, two flaps 29 and 31 are punched from one flange of each guide rail 20 at the upper end thereof, viz, from the flange which is connected to the window casement 10. One flap 29 is folded towards the other flange of the guide rail and defines together with said other flange a narrow elongated opening 30, and the other flap 31 is bent to a horizontal position to form a supporting surface.

When the guide rails 20 have been connected to the window casement 10 the supporting rail 11 can be mounted in the horizontal position thereof between the upper ends of the guide rails in a manner to be described below.

Figure 10:
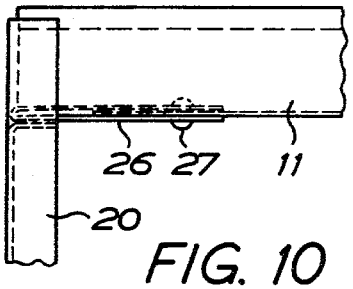
FIG. 10 is a fragmentary side view of the suspension rail and one guide rail locked to each other.
Figure 11:
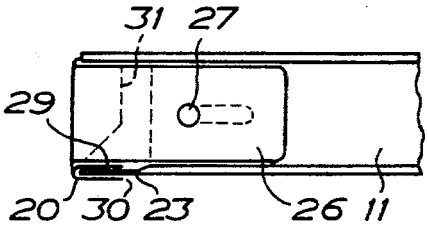
FIG. 11 is a plan view of the suspension rail of FIG. 10 with the guide rail shown from one end thereof.

With the latch slide 26 in the off position according to FIG. 5 and with the slats of the Venetian blind stacked, the blind including the suspension rail is inserted between the guide rails 20 in a tilted position, the right end of the suspension rail being at a higher level than the left end thereof. At the right end of the suspension rail one upright side of said rail is inserted into the narrow elongated opening 30 formed by the guide rail 20 mounted to the right section of the window casement, and the web of the suspension rail is engaged with the upper side of the flap 31 of said guide rail. Then, the left end of the suspension rail is swung upwards such that the projecting portion 23 of the upright side of the rail will be inserted into the narrow elongated opening 30 of the left guide rail 20, and when this has been done the suspension rail is locked in this position by the latch slide 26 being displaced to the latch position according to FIG. 6 on the upper side of the flap 31 of the left guide rail. The latching engagement thus provided between the left guide rail and the suspension rail is shown in FIGS. 10 and 11. The suspension rail is now securely mounted in the groove 22 between the two guide rails. The mounting of the Venetian blind is completed by connecting the operating mechanism 14 through one open end of the suspension rail 11, to the rod 16 at the connection 17, also the pull cord 18 being passed from the suspension rail through said open end. The blind is then ready for use.

When the groove 22 formed by the window casement 10 is so deep that the suspension rail 11 and the guide rails 20 project beyond the window casement as show in FIG. 2, the operating rod 15 can be connected to the mechanism 14 through one open end of the suspension rail 11 where also the pull cord 18 is passed from the suspension rail as described above. However, if the groove 22 is considerably deeper, which is not unusual, so that the suspension rail 11 and the guide rails 20 are received in their entirety by the groove as is shown in FIG. 13, it is not possible to connect the operating rod 15 and to pass the pull cord 18 through one end of the suspension rail 11. In order to make possible that the Venetian blind is arranged in a suitable manner without the necessity of drilling passages in the window casement 10, it is proposed according to the invention an arrangement disclosed in FIGS. 12 and 14 to 16.

Figure 14:
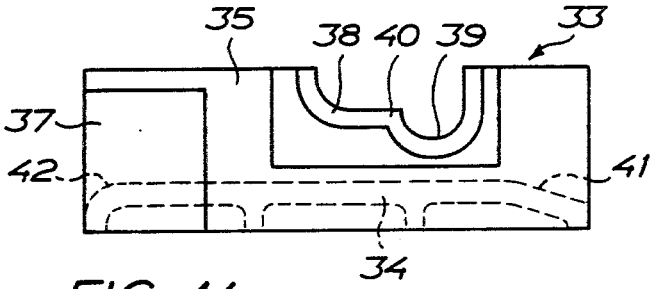
FIG. 14 is a side view of a conducting piece arranged in the channelled suspension rail.
Figure 15:
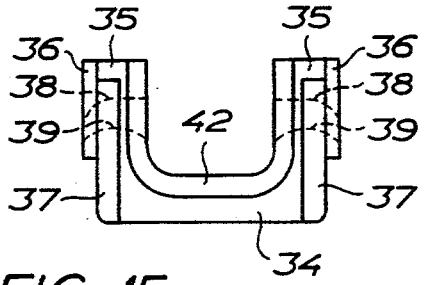
FIG. 15 is an end view of the conducting piece of FIG. 14.
Figure 16:
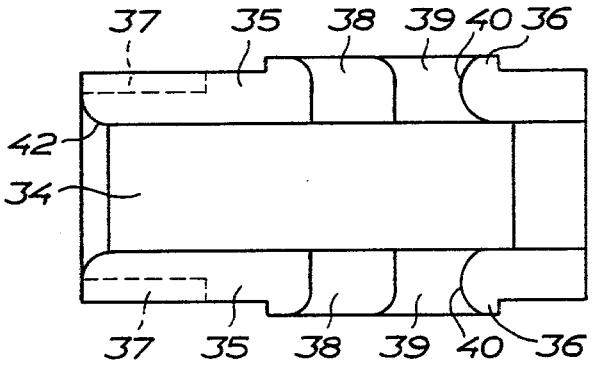
FIG. 16 is a plan view of the conducting piece of FIGS. 14 and 15.

In this embodiment there is provided in the suspension rail 11 a rectangular notch 32 in each of the upright sides of the rail, said notches being located one opposite to the other adjacent one end of the suspension rail. In the suspension rail, a conducting piece 33 is arranged formed as is shown in FIGS. 14 to 16. The conducting piece 33 comprises a U-shaped plastic body with a web 34 and side flanges 35. The plastic body has on the outside of each side flange a projecting portion 36 and these projecting portions are dimensioned to fit in the notches 37 when the conducting piece is mounted in the suspension rail 11 with the web 34 of the conducting piece resting on the bottom or web of the suspension rail. By engagement of the projecting portions 36 in the notches 32 the conducting piece is held in a fixed position in the suspension rail. The side flanges 35 has on the outside thereof also two recesses 37 to receive therein the flap 29 and the corresponding flap at the opposite side of the suspension rail 11.

In each of the side flanges 35 of the conducting piece there is provided in the region of the projecting portion 36 a recess with two portions 38 and 39 of different depths, portion 39 having a larger depth than portion 38, the recess being bound by a smoothly curved edge portion 40. Also the web 34 has on the inner side thereof smoothly curved portions 41 and 42 at the ends of the conducting piece.

Figure 12:
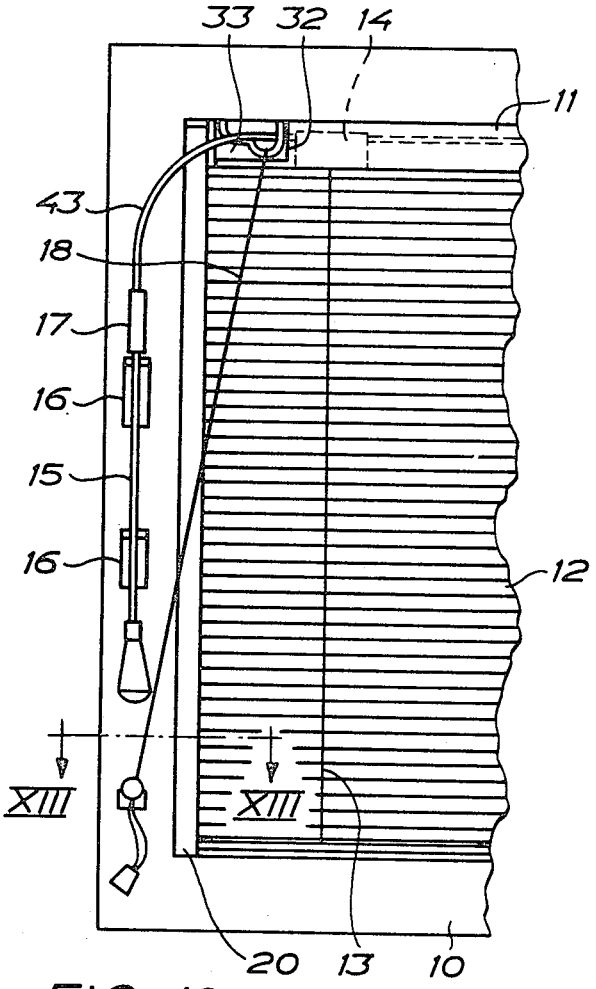
FIG. 12 is a fragmentary front view of a window casement with a Venetian blind according to another embodiment of the invention.
Figure 13:
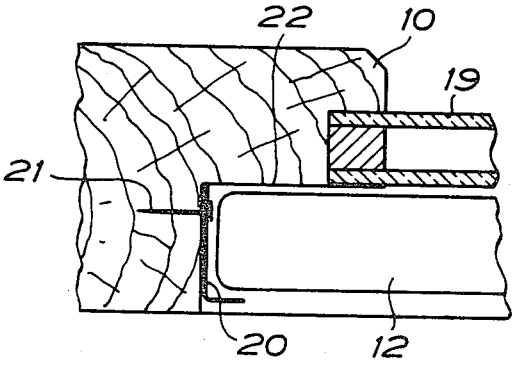
FIG. 13 is an enlarged fragmentary cross-sectional view taken along line XIII—XIII in FIG. 12.

As will be seen from FIG. 12, the operating rod 15 is connected by means of a flexible shaft 43 to the operating mechanism 14, the flexible shaft being extended from the channelled suspension rail 11 at one side thereof through the conducting piece 33, said shaft being passed through portion 38 of the recess in one side flange 35 of the conducting piece. Also the pull cord 18 is extended from the suspension rail 11 at one side thereof passing through portion 39 of the recess below the flexible shaft 43. Thus, it is avoided that the pull cord is jammed between the flexible shaft 43 and the conducting piece 33.

The conducting piece 33 thus makes possible that the flexible shaft 43 and the pull cord 18 are extended from the suspension rail 11 at one side or the other of the rail, and also makes possible that the shaft and the pull cord are extended from the end of the suspension rail if this can be done considering the depth of the groove 22. The smoothly curved portions of the conducting piece eliminate the risk of the pull cord being exposed to wear against sharp edges.

I claim:

1. A venetian blind having a plurality of slats for mounting in a window casement, said venetian blind comprising a channelled suspension rail horizontally arranged at the top of said window casement, an operating mechanism mounted to said suspension rail for manipulation of said slats, a pull cord, a flexible shaft connected to said operating mechanism, a conducting piece arranged in said channelled suspension rail for the extension of said pull cord and said flexible shaft through an opening formed in the side of said suspension rail, a pair of guide rails for guiding said slats, said guide rails vertically mounted along opposed vertical sides of said window casement and supporting said suspension rail horizontally therebetween, engaging means arranged on one of said guide rails for releasably engaging an adjacent portion of one end of said suspension rail, and a latch element arranged at the other end of said suspension rail for securely engaging an adjacent portion of the other of said guide rails upon manipulation of said latch element.

2. The venetian blind as claimed in claim 1 wherein said latch element comprises a latch slide mounted to the bottom of said channelled suspension rail.

3. The ventian blind as claimed in claim 1 wherein each of said guide rails include a support for supporting said suspension rail horizontally therebetween at the top of said window casement.

4. The venetian blind as claimed in claim 3 wherein said latch slide comprises a flat slide, said flat slide being displaceable between a latching position engaging the top of said support provided on said other guide rail and an off position in which said latch slide is withdrawn from engagement with said support.

5. The venetian blind as claimed in claim 4 wherein said flat slide comprises a sheet folded upon itself and arranged for engaging the top of said support when arranged in said latching position.

6. The venetian blind as claimed in claim 1 wherein said engaging means comprises an opening formed by a folded portion of said one of said guide rails for releasably receiving therein one of the sides of said channelled suspension rail.

7. The venetian blind as claimed in claim 6 wherein each of said guide rails includes an opening formed by a folded portion thereof to receive therein an end portion of one of the sides of said channelled suspension rail.

8. The venetian blind as claimed in claim 1 wherein said conducting piece comprises a channelled plastic body removably inserted into said suspension rail with the bottom of said body engaging the bottom of said suspension rail, said body having a recess formed in the sides thereof for the extension of said pull cord and said flexible shaft.

9. The venetian blind as claimed in claim 8 wherein said recess includes a first portion for receiving said flexible shaft at the adjacent end of said suspension rail and a second portion of greater depth than said first portion and located inwardly of said first portion for receiving said pull cord.

10. The venetian blind as claimed in claim 9 wherein said second portion is bound by curved edge surfaces for slidably engaging said pull cord.

11. The venetian blind as claimed in claim 1 wherein said conducting piece includes a projecting portion on the outside of at least one side thereof, said projecting portion received within said opening formed in the side of said suspension rail.

12. A venetian blind having a plurality of slats for mounting in a window casement, said venetian blind comprising a channelled suspension rail horizontally arranged at the top of said window casement, an operating mechanism mounted to said suspension rail for manipulation of said slats, a pair of guide rails for guiding said slats and each including an opening formed by a folded portion thereof to receive therein an end portion of one of the sides of said channelled suspension rail, said guide rails vertically mounted along opposed vertical sides of said window casement and each including a support for supporting said suspension rail horizontally therebetween at the top of said window casement, engaging means arranged on one of said guide rails for releasably engaging an adjacent portion of one end of said suspension rail, and a latch element arranged at the other end of said suspension rail for securely engaging an adjacent portion of the other of said guide rails upon manipulation of said latch element, said latch element including a latch slide mounted to the bottom of said channelled suspension rail, said latch slide including a flat slide, said flat slide being displaceable between a latching position engaging the top of said support provided on said other guide rail and an off position in which said latch slide is withdrawn from engagement with said support.

13. The venetian blind as claimed in claim 12 further comprising a pull cord, a flexible shaft connected to said operating mechanism, and a conducting piece arranged in said channelled suspension rail for the extension of said pull cord and said flexible shaft through an opening formed in the side of said suspension rail.

14. The venetian blind as claimed in claim 13 wherein said conducting piece comprises a channelled plastic body removably inserted into said suspension rail with the bottom of said body engaging the bottom of said suspension rail, said body having a recess formed in the sides thereof for the extension of said pull cord and said flexible shaft.

15. The venetian blind as claimed in claim 14 wherein said recess includes a first portion for receiving said flexible shaft at the adjacent end of said suspension rail, and a second portion of greater depth than said first portion and located inwardly of said first portion for receiving said pull cord.

16. The venetian blind as claimed in claim 15 wherein said second portion is bound by curved edge surfaces for slidably engaging said pull cord.

17. The venetian blind as claimed in claim 13 wherein said conducting piece includes a projecting portion on the outside of at least one side thereof, said projecting portion received within said opening formed in the side of said suspension rail.

18. The venetian blind as claimed in claim 12, wherein said flat slide comprises a sheet folded upon itself and arranged for engaging the top of said support when arranged in said latching position.

19. The venetian blind as claimed in claim 12 wherein said engaging means comprises an opening formed by a folded portion of said one of said guide rails for releasably receiving therein one of the sides of said channelled suspension rail.

* * * * *